US012121053B2

(12) United States Patent
Ki et al.

(10) Patent No.: US 12,121,053 B2
(45) Date of Patent: Oct. 22, 2024

(54) AEROSOL GENERATING ARTICLE

(71) Applicant: KT&G CORPORATION, Daejeon (KR)

(72) Inventors: Sung Jong Ki, Daejeon (KR); John Tae Lee, Daejeon (KR); Young Joong Kim, Daejeon (KR); In Su Park, Seoul (KR); Sun Hwan Jung, Daejeon (KR); Eun Mi Jeoung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 602 days.

(21) Appl. No.: 17/430,592

(22) PCT Filed: Dec. 15, 2020

(86) PCT No.: PCT/KR2020/018383

§ 371 (c)(1),
(2) Date: Aug. 12, 2021

(87) PCT Pub. No.: WO2021/182727

PCT Pub. Date: Sep. 16, 2021

(65) Prior Publication Data

US 2022/0400737 A1 Dec. 22, 2022

(30) Foreign Application Priority Data

Mar. 9, 2020 (KR) ..... 10-2020-0029163

(51) Int. Cl.
*A24D 1/20* (2020.01)
*A24D 1/02* (2006.01)

(52) U.S. Cl.
CPC ..... *A24D 1/20* (2020.01); *A24D 1/027* (2013.01)

(58) Field of Classification Search
None
See application file for complete search history.

(56) References Cited

U.S. PATENT DOCUMENTS 9,439,453 B2 9/2016 Conner et al.
10,010,110 B2 7/2018 Metrangolo et al.
(Continued)

FOREIGN PATENT DOCUMENTS

CN 105722416 A 6/2016
CN 109496128 A 3/2019
(Continued)

OTHER PUBLICATIONS

Extended European Search Report issued Mar. 17, 2022 in European Application No. 20917268.3.
(Continued)

*Primary Examiner* — Ross N Gushi
(74) *Attorney, Agent, or Firm* — Sughrue Mion, PLLC

(57) ABSTRACT

An aerosol generating article includes: a first portion comprising an aerosol generating material; a second portion comprising a tobacco material including a moisturizing agent; a third portion configured to cool airflow that has passed through the first portion and the second portion; a fourth portion comprising a filter material; and a wrapper that surrounds the first portion, the second portion, the third portion, wherein the second portion includes the moisturizing agent in an amount of 10 wt % or less based on a total weight of the tobacco material such that heat conductivity in the second portion is improved.

12 Claims, 9 Drawing Sheets

(56) References Cited

U.S. PATENT DOCUMENTS

| | | | | |
|---|---|---|---|---|
| 10,617,149 | B2 | 4/2020 | Malgat et al. | |
| 10,772,349 | B2 * | 9/2020 | Beeson | A24B 15/246 |
| 11,684,080 | B2 * | 6/2023 | Narasimhan | A24B 15/287 131/329 |
| 2008/0163879 | A1 | 7/2008 | Rodrigues et al. | |
| 2013/0104915 | A1 * | 5/2013 | Eitzinger | A24D 1/027 131/365 |
| 2016/0331032 | A1 | 11/2016 | Malgat et al. | |
| 2017/0303588 | A1 | 10/2017 | Batista | |
| 2019/0098927 | A1 | 4/2019 | Mironov | |
| 2019/0269169 | A1 | 9/2019 | Malgat | |
| 2020/0359688 | A1 | 11/2020 | Jang et al. | |
| 2021/0368860 | A1 * | 12/2021 | Reevell | A24B 15/281 |

FOREIGN PATENT DOCUMENTS

| | | | |
|---|---|---|---|
| EP | 3076815 | A1 | 10/2016 |
| JP | 2015-523857 | A | 8/2015 |
| JP | 5976637 | B2 | 8/2016 |
| JP | 2016-538848 | A | 12/2016 |
| KR | 10-2016-0094938 | A | 8/2016 |
| KR | 10-2019-0093027 | A | 8/2019 |
| WO | 2005/058078 | A2 | 6/2005 |
| WO | 2015/082649 | A1 | 6/2015 |
| WO | 2017/182485 | A1 | 10/2017 |
| WO | 2019/110747 | A1 | 6/2019 |
| WO | 2020/025714 | A1 | 2/2020 |

OTHER PUBLICATIONS

Communication dated Nov. 11, 2021 from the Korean Intellectual Property Office in Application No. 10-2020-0029163.
Written Opinion for PCT/KR2020/018383, dated Mar. 24, 2021.
International Search Report for PCT/KR2020/018383, dated Mar. 24, 2021.
Notification of Reasons for Refusal dated Oct. 18, 2022 from the Japanese Patent Office in Application No. 2021-556898.
Chinese Office Action dated Apr. 20, 2023 in Application No. 202080018841.9.

* cited by examiner

AEROSOL GENERATING ARTICLE

CROSS REFERENCE TO RELATED APPLICATIONS

This application is a National Stage of International Application No. PCT/KR2020/018383 filed Dec. 15, 2020, claiming priority based on Korean Patent Application No. 10-2020-0029163 filed Mar. 9, 2020.

TECHNICAL FIELD

One or more embodiments relate to an aerosol generating article.

BACKGROUND ART

Recently, the demand for alternatives to aerosol generating articles has increased. For example, there is growing demand for an aerosol generating device that generates an aerosol by heating an aerosol generating material in an aerosol generating article, rather than by combusting an aerosol generating article.

In the case of a combustive aerosol generating article, the aerosol may not be sufficiently generated to the smoker's satisfaction. In this regard, studies on a heating-type aerosol generating article have been actively conducted.

DISCLOSURE

Technical Solution

According to one or more embodiments, problems according to the related art can be solved.

However, the technical solution is not limited to the above, and other technical solutions may be inferred from the following examples.

Advantageous Effects

According to one or more embodiments, a smoker can smoke by heating an aerosol generating article using an aerosol generating device, or the smoker can smoke by combusting the aerosol generating article directly.

In addition, according to one or more embodiments, by containing a moisturizing agent in a certain amount or less in the second portion of the aerosol generating article, thermal conductivity or the aerosol generating amount of the aerosol generating article can be remarkably increased.

The effects of the present disclosure are not limited to the above but may include all effects that may be inferred from the following description.

BEST MODE

Figure 1:
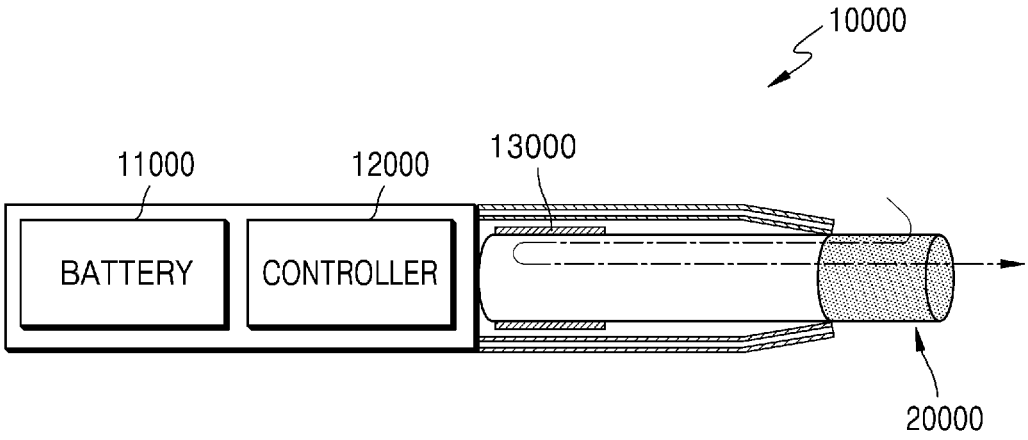
FIG. 1 is a view illustrating an example in which an aerosol generating article is inserted into an aerosol generating device, according to an embodiment.

According to an aspect of the present disclosure, an aerosol generating article includes a first portion comprising an aerosol generating material; a second portion comprising a tobacco material including a moisturizing agent; a third portion configured to cool airflow that has passed through the first portion and the second portion; a fourth portion comprising a filter material; and a wrapper that surrounds the first portion, the second portion, the third portion, and the fourth portion, wherein the first portion, the second portion, the third portion, and the fourth portion are sequentially arranged in a longitudinal direction of the aerosol generating article, and wherein the second portion comprises the moisturizing agent in an amount of 10 wt % or less based on a total weight of the tobacco material.

The second portion may include the moisturizing agent in an amount of 2 wt % to 8 wt % based on a total weight of the tobacco material.

The wrapper may include a plurality of perforations arranged between an area covering the first portion and an area covering the second portion.

The plurality of perforations may be arranged on the wrapper at regular intervals.

A nicotine transfer amount of the aerosol generating article may be 0.1 to 3.0 mg/stick.

Along a longitudinal direction of the aerosol generating article, the first portion may extend by 7 to 20 mm, and the second portion may extend by 7 to 20 mm from a point where the first portion ends.

According to a second aspect of the present disclosure, an aerosol generating system includes the aerosol generating article according to the first aspect and an aerosol generating device configured to heat at least one of the first portion and the second portion of the aerosol generating article.

The second portion may include the moisturizing agent in an amount of 2 wt % to 8 wt % based on a total weight of the tobacco material.

The wrapper may include a plurality of perforations arranged between an area covering the first portion and an area covering the second portion.

The plurality of perforations may be arranged on the wrapper at regular intervals.

A nicotine transfer amount of the aerosol generating article may be 0.1 to 3.0 mg/stick.

Along a longitudinal direction of the aerosol generating article, the first portion may extend by 7 to 20 mm, and the second portion may extend by 7 to 20 mm from a point where the first portion ends.

Means for solving the problem is not limited to the above, and the present disclosure may include all matters that can be inferred by those skilled in the art throughout the specification.

MODE FOR INVENTION

With respect to the terms in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Throughout the specification, "A and/or B" refers to at least one of A and B.

Throughout the specification, "to be positioned on" means that a member is positioned on one side of another member, and includes all cases where a member is positioned in contact with or without contact with another member.

Throughout the specification, a "longitudinal direction of an aerosol generating article" may be a direction in which the length of an aerosol generating article extends or a direction in which the aerosol generating article is inserted into an aerosol generating device.

Hereinafter, embodiments of the present disclosure will be described in detail with reference to the accompanying drawings.

Figure 2:
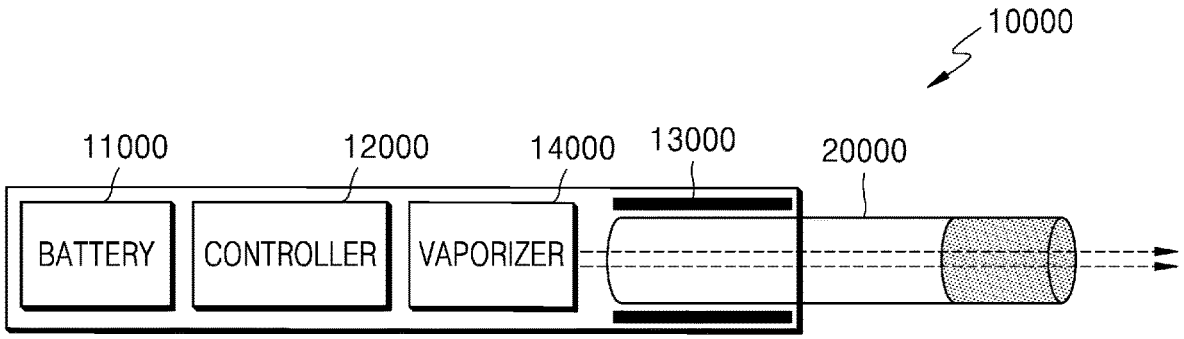
FIG. 2 is a view illustrating an example in which an aerosol generating article is inserted into an aerosol generating device, according to another embodiment.
Figure 3:
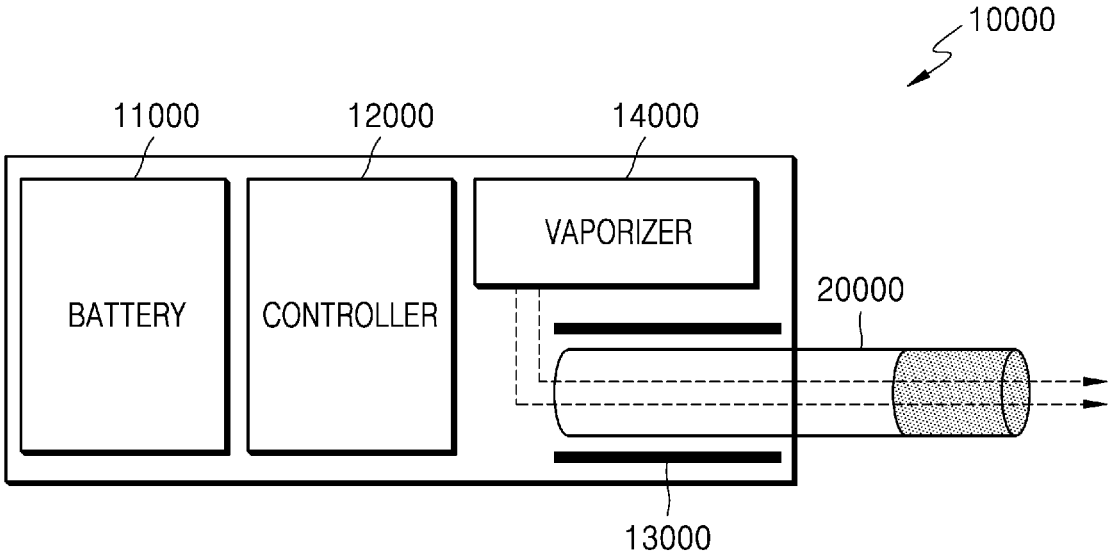
FIG. 3 is a view illustrating an example in which an aerosol generating article is inserted into an aerosol generating device, according to another embodiment.

FIGS. 1 through 3 are diagrams showing examples in which an aerosol generating article 20000 is inserted into an aerosol generating device 10000.

Referring to FIG. 1, the aerosol generating device 10000 may include a battery 11000, a controller 12000, and a heater 13000. Referring to FIGS. 2 and 3, the aerosol generating device 10000 may further include a vaporizer 14000. Also, the aerosol generating article 20000 may be inserted into an inner space of the aerosol generating device 10000.

FIGS. 1 through 3 illustrate components of the aerosol generating device 10000, which are related to the present embodiment. Therefore, it will be understood by one of ordinary skill in the art related to the present embodiment that other general-purpose components may be further included in the aerosol generating device 10000, in addition to the components illustrated in FIGS. 1 through 3.

Also, FIGS. 2 and 3 illustrate that the aerosol generating device 10000 includes the heater 13000. However, as necessary, the heater 13000 may be omitted.

FIG. 1 illustrates that the battery 11000, the controller 12000, and the heater 130000 are arranged in series. Also, FIG. 2 illustrates that the battery 11000, the controller 12000, the vaporizer 14000, and the heater 13000 are arranged in series. Also, FIG. 3 illustrates that the vaporizer 14000 and the heater 13000 are arranged in parallel. However, the internal structure of the aerosol generating device 10000 is not limited to the structures illustrated in FIGS. 1 through 3. In other words, according to the design of the aerosol generating device 10000, the battery 11000, the controller 12000, the heater 13000, and the vaporizer 14000 may be differently arranged.

When the aerosol generating article 20000 is inserted into the aerosol generating device 10000, the aerosol generating device 10000 may operate the heater 13000 and/or the vaporizer 14000 to generate an aerosol from the aerosol generating article 20000 and/or the vaporizer 14000. The aerosol generated by the heater 13000 and/or the vaporizer 14000 is delivered to a user by passing through the aerosol generating article 20000.

As necessary, even when the aerosol generating article 20000 is not inserted into the aerosol generating device 10000, the aerosol generating device 10000 may heat the heater 13000.

The battery 11000 may supply power to be used for the aerosol generating device 10000 to operate. For example, the battery 11000 may supply power to heat the heater 13000 or the vaporizer 14000, and may supply power for operating the controller 12000. Also, the battery 11000 may supply power for operations of a display, a sensor, a motor, etc. mounted in the aerosol generating device 10000.

The controller 12000 may generally control operations of the aerosol generating device 10000. In detail, the controller 12000 may control not only operations of the battery 11000, the heater 13000, and the vaporizer 14000, but also operations of other components included in the aerosol generating device 10000. Also, the controller 12000 may check a state of each of the components of the aerosol generating device 10000 to determine whether or not the aerosol generating device 10000 is able to operate.

The controller 12000 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13000 may be heated by the power supplied from the battery 11000. For example, when the aerosol generating article 20000 is inserted into the aerosol generating device 10000, the heater 13000 may be located outside the aerosol generating article 20000. Thus, the heated heater 13000 may increase a temperature of an aerosol generating material in the cigarette 20000.

The heater 13000 may include an electro-resistive heater. For example, the heater 13000 may include an electrically conductive track, and the heater 13000 may be heated when currents flow through the electrically conductive track. However, the heater 13000 is not limited to the example described above and may include all heaters which may be heated to a desired temperature. Here, the desired temperature may be pre-set in the aerosol generating device 10000 or may be set as a temperature desired by a user.

As another example, the heater 13000 may include an induction heater. In detail, the heater 13000 may include an electrically conductive coil for heating aerosol generating article in an induction heating method, and the aerosol generating article may include a susceptor which may be heated by the induction heater.

For example, the heater 13000 may include a tube-type heating element, a plate-type heating element, a needle-type heating element, or a rod-type heating element, and may heat the inside or the outside of the aerosol generating article 20000, according to the shape of the heating element.

Also, the aerosol generating device 10000 may include a plurality of heaters 13000. Here, the plurality of heaters 13000 may be inserted into the aerosol generating article 20000 or may be arranged outside the aerosol generating article 20000. Also, some of the plurality of heaters 13000 may be inserted into the aerosol generating article 20000 and the others may be arranged outside the aerosol generating article 20000. In addition, the shape of the heater 13000 is not limited to the shapes illustrated in FIGS. 1 through 3 and may include various shapes.

The vaporizer 14000 may generate an aerosol by heating a liquid composition and the generated aerosol may pass through the aerosol generating article 20000 to be delivered to a user. In other words, the aerosol generated via the vaporizer 14000 may move along air flow passage of the aerosol generating device 10000 and the air flow passage may be configured such that the aerosol generated via the vaporizer 14000 passes through the cigarette 20000 to be delivered to the user.

For example, the vaporizer 14000 may include a liquid storage, a liquid delivery element, and a heating element, but it is not limited thereto. For example, the liquid storage, the liquid delivery element, and the heating element may be included in the aerosol generating device 10000 as independent modules.

The liquid storage may store a liquid composition. For example, the liquid composition may be a liquid including a tobacco-containing material having a volatile tobacco flavor component, or a liquid including a non-tobacco material. The liquid storage may be formed to be attached/detached to/from the vaporizer 14000 or may be formed integrally with the vaporizer 14000.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14000 may be referred to as a cartomizer or an atomizer, but it is not limited thereto.

The aerosol generating device 10000 may further include other components in addition to the battery 11000, the controller 12000, the heater 13000, and the vaporizer 14000. For example, the aerosol generating device 10000 may include a display capable of outputting visual information and/or a motor for outputting haptic information. Also, the aerosol generating device 10000 may include at least one sensor (e.g., a puff detecting sensor, a temperature detecting sensor, a cigarette insertion detecting sensor, etc.). Also, the aerosol generating device 10000 may be formed as a structure where, even when the cigarette 20000 is inserted into the aerosol generating device 10000, external air may be introduced or internal air may be discharged.

Although not illustrated in FIGS. 1 through 3, the aerosol generating device 10000 and an additional cradle may form together a system. For example, the cradle may be used to charge the battery 11000 of the aerosol generating device 10000. Alternatively, the heater 13000 may be heated when the cradle and the aerosol generating device 10000 are coupled to each other.

In an example, the external air may be introduced through at least one air passage formed in the aerosol generating device 10000. For example, the opening or closing or size of the air passage formed in the aerosol generating device 10000 may be adjusted by the user. Accordingly, the amount and quality of smoke (e.g., aerosols) may be adjusted by the user. In another example, the external air may be introduced into an aerosol generating article 20000 through at least one hole formed in the surface of the aerosol generating article 20000.

Figure 4:
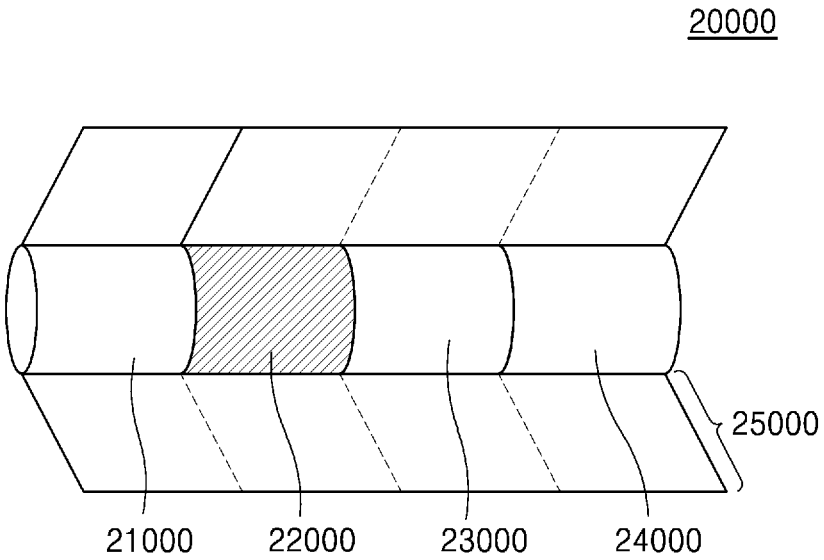
FIG. 4 is a view schematically illustrating the configuration of an aerosol generating article according to an embodiment.

FIG. 4 is a view schematically illustrating the configuration of the aerosol generating article 20000 according to an embodiment.

According to an embodiment, the aerosol generating article 20000 may include a first portion 21000, a second portion 22000, a third portion 23000, and a fourth portion 24000, which are sequentially arranged in a longitudinal direction of the aerosol generating article 20000. In an example, the first portion 21000 may include an aerosol generating material, the second portion 22000 may include a tobacco material and a moisturizing agent, the third portion 23000 may cool airflow passing through the first portion 21000 and the second portion 22000, and the fourth portion 24000 may include a filter material.

In an embodiment, the first portion 21000, the second portion 22000, the third portion 23000, and the fourth portion 24000 may be sequentially arranged in a longitudinal direction of the aerosol generating article 20000. Thus, an aerosol generated from at least one of the first portion 21000 and the second portion 22000 may form airflow sequentially passing through the first portion 21000, the second portion 22000, the third portion 23000, and the fourth portion 24000. Thus, the smoker may inhale the aerosol from the fourth portion 24000.

In an embodiment, the first portion 21000 may have a length of about 7 to about 20 mm, and the second portion 22000 may have a length of about 7 to about 20 nm. However, this numerical range is not limited, and the length by which each of the first portion 21000 and the second portion 22000 extends, may be properly adjusted within a range that may be easily changed by those skilled in the art.

In detail, the first portion 21000 may include an aerosol generating material. Here, the aerosol generating material may include at least one of glycerin, propylene glycol, dipropylene glycol, diethylene glycol, triethylene glycol, tetraethylene glycol, and oleyl alcohol, for example.

The second portion 22000 may include a tobacco material. The tobacco material may be, for example, tobacco leaves, tobacco side veins, puffed tobacco, cut tobacco leaf, a cut tobacco leaf of reconstituted tobacco leaves, reconstituted tobacco, and a combination thereof.

The third portion 23000 may cool the airflow that has passed through the first portion 21000 and the second portion 22000. The third portion 23000 may be manufactured of a polymer material or biodegradable polymer material and may have a cooling function. For example, the third portion 23000 may be manufactured of a poly lactic acid (PLA) fiber, but embodiments are not limited thereto. Alternatively, the third portion 23000 may be manufactured of a cellulose acetate filter having a plurality of holes. However, the third portion 23000 is not limited to the above-described examples, and a material that performs a function of cooling an aerosol may be used to implement the third portion 23000 without limitation. For example, the third portion 23000 may be a tube filter or branch pipe filter including a hollow.

The fourth portion 24000 may include a filter material. For example, the fourth portion 24000 may be a cellulose acetate filter. There is no limit to the shape of the fourth portion 24000. For example, the fourth portion 24000 may be a cylindrical rod or a tube-type rod including a hollow inside. Also, the fourth portion 24000 may be a recess type rod. If the fourth portion 24000 includes a plurality of segments, at least one of the plurality of segments may be manufactured in another shape.

The fourth portion 24000 may be manufactured to generate flavor. In an example, a flavoring liquid may be sprayed on the fourth portion 24000, and a separate fiber coated with the flavoring liquid may be inserted into the fourth portion 24000.

The aerosol generating article 20000 may include a wrapper 25000 that surrounds at least part of the first portion 21000 through the fourth portion 24000. Also, the aerosol generating article 20000 may include a wrapper 25000 that surrounds all of the first portion 21000 through the fourth portion 24000. The wrapper 25000 may be located at the outermost part of the aerosol generating article 20000. The wrapper 25000 may be a single wrapper or a combination of a plurality of wrappers.

In an example, the first portion 21000 of the aerosol generating article 20000 may include a crimped corrugated sheet including an aerosol generating material, and the second portion 22000 may include a tobacco material such as cut tobacco obtained from reconstituted tobacco sheet, and a moisturizing agent such as glycerin. Also, the third portion 23000 may include a paper pipe, and the fourth portion 24000 may include a cellulose acetate (CA) fiber, but the present disclosure is not limited thereto.

When the aerosol generating article 20000 is coupled to the aerosol generating device 10000, the first portion 21000 may be inserted in the aerosol generating device 10000, and second through fourth portions thereof may be exposed to the outside. Also, the entire first portion 21000 and part of the second portion 22000 may be inserted in the aerosol generating device 10000. In another embodiment, the first portion 21000 and the second portion 22000 may be fully inserted into the aerosol generating device 10000. The user may inhale the aerosol while the fourth portion 24000 is put into the mouth. At this time, an aerosol may be generated when the external air passes through the first portion 21000 and/or the second portion 22000, and the generated aerosol may pass through the third portion 23000 and the fourth portion 2400 and may be delivered to the user's mouth.

Figure 5:
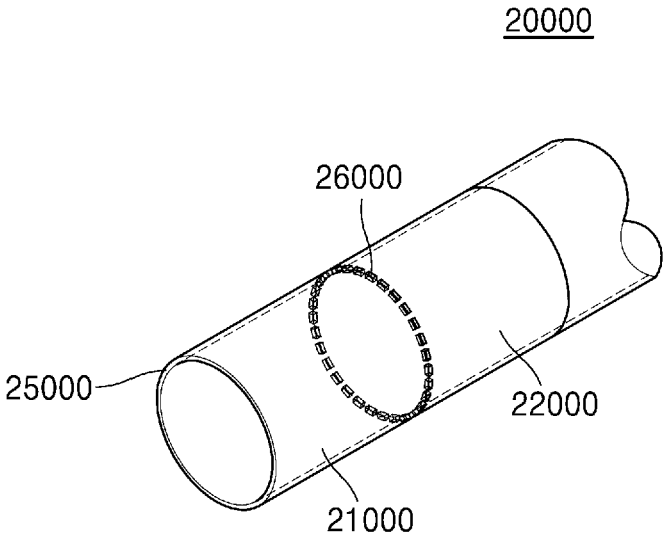
FIG. 5 is a perspective view of one end of an aerosol generating article according to an embodiment.

FIG. 5 is a view showing one end of an aerosol generating article 20000 according to an embodiment.

The description of the aerosol generating device 10000 provided above with reference to FIG. 4 may be applied to the embodiment of FIG. 5.

Referring to FIG. 5, the aerosol generating material 20000 may include a first portion 21000, a second portion 22000, a third portion (not shown), a fourth portion (not shown), a wrapper 25000, and a plurality of perforations 26000.

In an embodiment, the plurality of perforations 26000 may be formed on the wrapper 25000. In detail, the perforations 26000 may be arranged between an area covering the first portion 21000 and an area covering the second portion 22000. The perforations 26000 may be arranged between the area covering the first portion 21000 and the area covering the second portion 22000 so that the first portion 21000 and the second portion 22000 of the aerosol generating article 20000 may be visually distinguished from each other.

The perforations 26000 may be formed on a circumference of the aerosol generating article 20000. About 5 to about 30 perforations 26000 may be formed on the circumference of the aerosol generating article 20000.

In an embodiment, the plurality of perforations 26000 may be arranged on the wrapper 25000 at regular intervals.

In an embodiment, the perforations 26000 may be formed by an on-line method or off-line method. In the case of using the on-line method, one perforation 26000 may have a long axis and a short axis. Thus, the number of perforations 26000 formed on the circumference of the aerosol generating article 20000 may be relatively small.

On the other hand, in the case of using the off-line method, one perforation 26000 may be formed in a circular shape. Thus, the number of perforations 26000 formed on the circumference of the aerosol generating article 20000 or the wrapper 25000 may be relatively large.

In an embodiment, the plurality of perforations 26000 may be arranged so that the first portion 21000 and the second portion 22000 may be distinguished from each other. In this case, due to the plurality of perforations 26000, a binding force between the first portion 21000 and the second portion 22000 of the aerosol generating article 20000 may be lower than that of other portions. Thus, as will be described later, the user may easily remove the first portion 21000 from the aerosol generating article 20000.

Also, the number of the plurality of perforations 26000 may be adjusted so that draw resistance (i.e., inhalation resistance) of the aerosol generating article 20000 may be adjusted.

Figure 6:
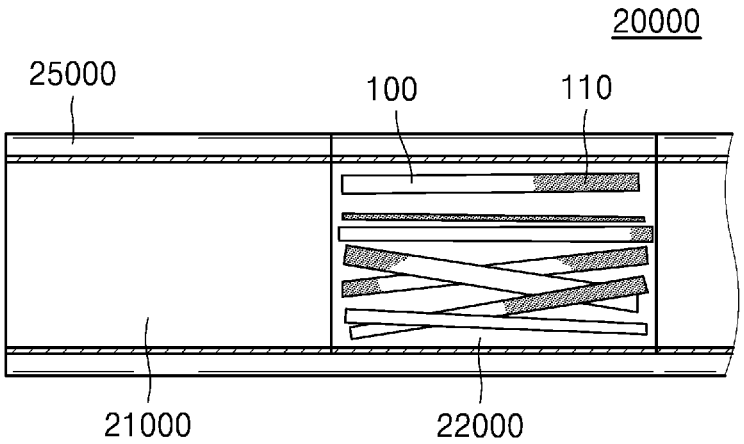
FIG. 6 is a cross sectional view of one end of an aerosol generating article according to an embodiment.

FIG. 6 is a cross sectional view of one end of the aerosol generating article 20000 according to an embodiment.

The contents of FIGS. 1 through 5 described previously may be applied to the embodiment of FIG. 6.

Referring to FIG. 6, the second portion 22000 of the aerosol generating article 20000 may include a tobacco material 100. For example, the second portion 22000 may include cut tobacco leaves. However, the present disclosure is not limited thereto.

The second portion 22000 may contain a moisturizing agent 110. The second portion 22000 may include glycerin or propylene glycol, for example, as the moisturizing agent 110.

The tobacco material 100 may include the moisturizing agent 110. All or part of the tobacco material 100 may include the moisturizing agent 110.

In an embodiment, the second portion 22000 may include the moisturizing agent 110 in an amount of about 10 wt % or less based on the total weight of the tobacco material 100. When the content of the moisturizing agent 110 exceeds about 10 wt %, thermal conductivity or aerosol generating amount inside the second portion 22000 may not be sufficient.

In an embodiment, the second portion 22000 may include the moisturizing agent 10 in an amount of about 2 wt % to about 8 wt % based on the total weight of the tobacco material 100 including the moisturizing agent 110. When the content of the moisturizing agent 110 is less than about 2 wt %, the aerosol generating amount may not be sufficient.

By including the moisturizing agent 110 as described above, thermal conductivity or an aerosol generating amount of the aerosol generating article 20000 may be remarkably increased. Also, as will be described later, when the user removes the first portion 21000 of the aerosol generating article 20000 and ignites the second portion 22000 to generate an aerosol, the user may ignite the second portion 22000 more easily. The above-described effects will be described in more detail with reference to FIGS. 8 and 9.

Figure 7:
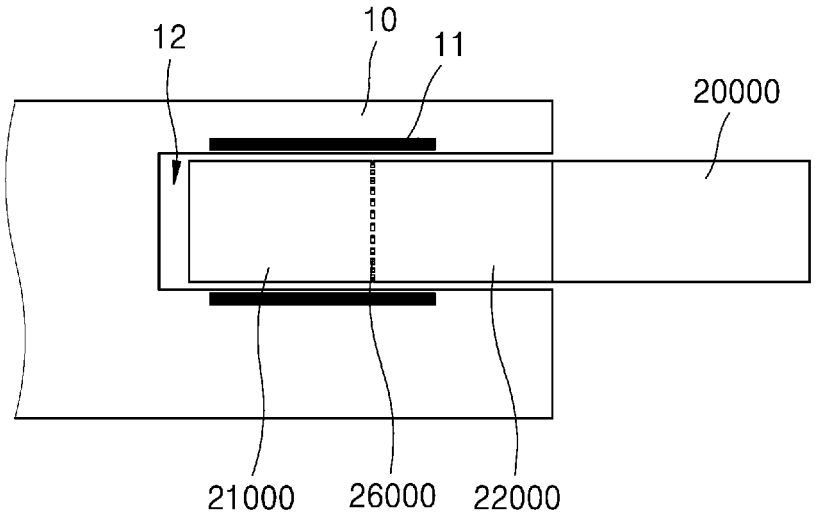
FIG. 7 is a view illustrating an example in which an aerosol generating article is inserted into an aerosol generating device, according to an embodiment.

FIG. 7 is a view showing an example in which the aerosol generating article 20000 is inserted into an aerosol generating device 10, according to an embodiment.

The contents of FIGS. 1 through 6 described above may be applied to the embodiment of FIG. 7.

Referring to FIG. 7, the aerosol generating device 10 may include a heating element 11 and an accommodation space 12 for accommodating the aerosol generating article 20000.

In an embodiment, the aerosol generating article 20000 may include a first portion 21000, a second portion 22000, and a plurality of perforations 26000. The aerosol generating article 20000 may be inserted into the accommodation space 12 of the aerosol generating device 10 and may be heated by the heating element 11.

In an embodiment, the heating element 11 may heat at least one of the first portion 21000 and the second portion 22000. For example, the heating element 11 may heat both the first portion 21000 and the second portion 22000. However, embodiments are not limited thereto.

In an embodiment, the second portion 22000 may include the moisturizing agent 110 in an amount of about 10 w % or less based on the total weight of the tobacco material 100, and the second portion 22000 may include the moisturizing agent 110 in an amount of about 2 wt % to about 8 wt % based on the total weight of the tobacco material 100.

Figure 8:
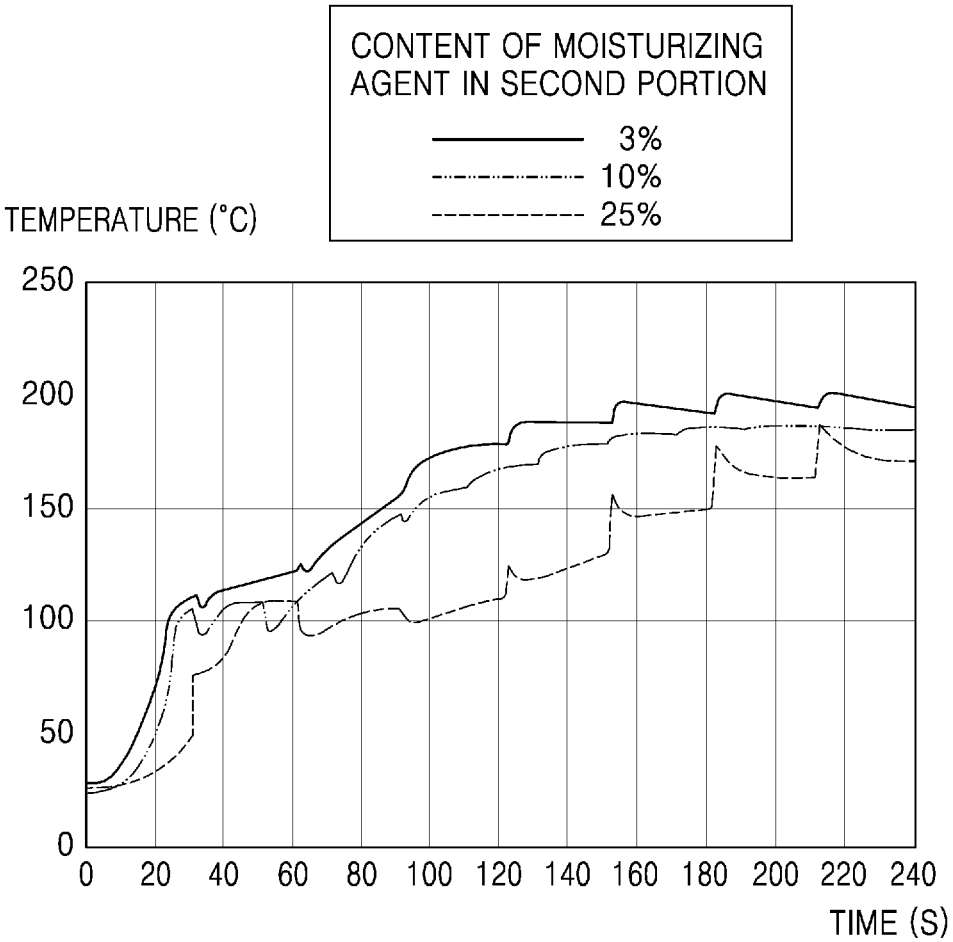
FIG. 8 is a graph showing changes in temperature of a second portion according to the content of a moisturizing agent when an aerosol generating article is heated.

FIG. 8 is a graph showing changes in temperature of a second portion when an aerosol generating article is heated.

The aerosol generating article includes a first portion, a second portion, a third portion, and a fourth portion, and the second portion includes a tobacco material and a moisturizing agent. The second portion is prepared to contain 3 wt %, 10 wt %, and 25 wt % of a moisturizing agent based on the total weight of the tobacco material. The second portion is heated by the same heater, and changes in temperature are measured and shown in a graph of FIG. 8.

As a result of experiments, a rapid change in temperature of the second portion over time appeared in the order of 3 wt %, 10 wt %, and 25 wt %. In particular, in the case of an aerosol generating article containing 3 wt % of a moisturizing agent, the temperature of the second portion rose to about 110° C. in a section of 0 to 30 seconds and reached to about 200° C. in a section of 180 to 200 seconds. On the other hand, in the case of an aerosol generating article containing 25 wt % of the moisturizing agent, the temperature of the second portion rose to about 75° C. in a section of 0 to 30 seconds and reached to about 180° C. in a section of 180 to 210 seconds.

Analyzing the results of the experiment, when the second portion contains the moisturizing agent 110 in an amount of about 10 wt % or less based on the total weight of the tobacco material, the temperature of the second portion more rapidly increased and converged at a higher temperature compared to the case where the second portion contains about 25 wt % of the moisturizing agent. This means that when the second portion contains the moisturizing agent in an amount of about 10 wt % or less, the thermal conductivity inside the second portion is further improved and an aerosol generating amount is further increased.

Also, when the second portion contains the moisturizing agent in an amount of about 2 wt % to about 8 wt % based on the total weight of the tobacco material, the thermal conductivity or aerosol generating amount inside the second portion may significantly increase compared to the case where the content of the moisturizing agent exceeds about 8 wt %. Thus, the user may have a satisfactory smoking feeling with the aerosol generating article.

A nicotine transfer amount of the aerosol generating article according to an embodiment may be about 0.1 to about 3.0 mg/stick. However, the present disclosure is not necessarily limited thereto, and the embodiments may be applied to other aerosol generating articles having various amounts of nicotine transfer.

Figure 9A:
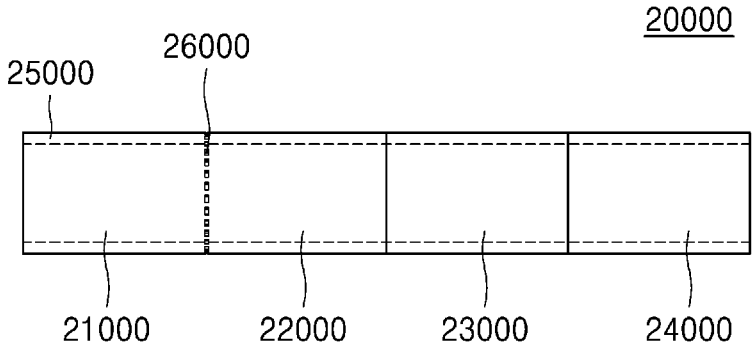
FIG. 9A is a view schematically illustrating the configuration of an aerosol generating article according to an embodiment.
Figure 9B:
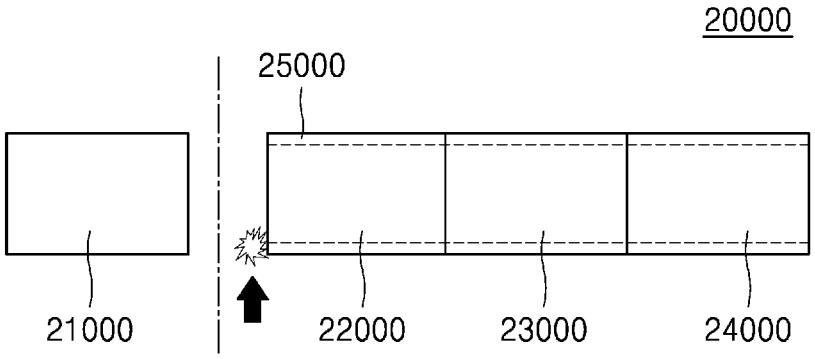
FIG. 9B illustrates that a first portion is removed from an aerosol generating article according to an embodiment.

FIG. 9A is a view schematically illustrating the configuration of an aerosol generating article 20000 according to an embodiment, and FIG. 9B illustrates that a first portion 21000 is detached from other portions of the aerosol generating article 20000, according to an embodiment.

Referring to FIG. 9A, the user may insert the entire aerosol generating article 20000 into an aerosol generating device (not shown) and may heat the aerosol generating article 20000 to generate an aerosol.

However, the user may generate an aerosol in a different way.

Referring to FIG. 9B, the user may easily remove the first portion 21000 from the aerosol generating article 20000 using a plurality of perforations 26000.

When the user removes the first portion 21000, the aerosol generating article 20000 may include a second portion 22000, a third portion 23000, and a fourth portion 24000.

The user may ignite the second portion 22000 to generate an aerosol.

In a specific embodiment, as described above, the second portion 22000 may include a moisturizing agent 110 in an amount of about 10 wt % or less based on the total weight of a tobacco material, and the second portion 22000 may include the moisturizing agent 110 in an amount of about 2 wt % to about 8 wt % based on the total weight of the tobacco material.

Since the second portion 22000 contains the moisturizing agent 110 in the above-described numerical range, the second portion 22000 may be more easily ignited.

At least one of the components, elements, modules or units (collectively "components" in this paragraph) represented by a block in the drawings, such as the controller 12000 in FIGS. 1-3, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

The descriptions of the above-described embodiments are merely examples, and it will be understood by one of ordinary skill in the art that various changes and equivalents thereof may be made. The scope of the present disclosure is defined by the appended claims rather than by the foregoing description, and all differences within the scope of equivalents thereof should be construed as being included in the present disclosure.

The invention claimed is:

1. An aerosol generating article comprising:

a first portion comprising an aerosol generating material;

a second portion comprising a tobacco material including a moisturizing agent;

a third portion configured to cool airflow that has passed through the first portion and the second portion;

a fourth portion comprising a filter material; and a wrapper that surrounds the first portion, the second portion, the third portion, and the fourth portion, wherein the first portion, the second portion, the third portion, and the fourth portion are sequentially arranged in a longitudinal direction of the aerosol generating article, wherein the second portion comprises the moisturizing agent in an amount of 10 wt % or less based on a total weight of the tobacco material, and wherein the first portion is configured to be detached from the second portion.

2. The aerosol generating article of claim 1, wherein the second portion comprises the moisturizing agent in an amount of 2 wt % to 8 wt % based on the total weight of the tobacco material.

3. The aerosol generating article of claim 1, wherein the wrapper comprises a plurality of perforations arranged between an area covering the first portion and an area covering the second portion.

4. The aerosol generating article of claim 3, wherein the plurality of perforations are arranged in the wrapper at regular intervals.

5. The aerosol generating article of claim 1, wherein a nicotine transfer amount of the aerosol generating article is 0.1 to 3.0 mg per aerosol generating article.

6. The aerosol generating article of claim 1, wherein, along the longitudinal direction of the aerosol generating article, the first portion extends by 7 to 20 mm, and the second portion extends by 7 to 20 mm from a point where the first portion ends.

7. An aerosol generating system comprising:

the aerosol generating article of claim 1; and an aerosol generating device configured to heat at least one of the first portion and the second portion of the aerosol generating article.

8. The aerosol generating system of claim 7, wherein the second portion comprises the moisturizing agent in an amount of 2 wt % to 8 wt % based on the total weight of the tobacco material.

9. The aerosol generating system of claim 7, wherein the wrapper comprises a plurality of perforations arranged between an area covering the first portion and an area covering the second portion.

10. The aerosol generating system of claim 9, wherein the plurality of perforations are arranged in the wrapper at regular intervals.

11. The aerosol generating system of claim 7, wherein a nicotine transfer amount of the aerosol generating article is 0.1 to 3.0 mg per aerosol generating article.

12. The aerosol generating system of claim 7, wherein, along the longitudinal direction of the aerosol generating article, the first portion extends by 7 to 20 mm, and the second portion extends by 7 to 20 mm from a point where the first portion ends.

* * * * *